US005588400A

United States Patent [19]

Stefan et al.

[11] Patent Number: 5,588,400

[45] Date of Patent: Dec. 31, 1996

[54] METHOD OF GENERATING STEAM IN A FORCED-THROUGH-FLOW BOILER

[75] Inventors: Ion Stefan; Friedrich Cesnik, both of Gummersbach, Germany

[73] Assignee: L. & C. Steinmuller GmbH, Gummersbach, Germany

[21] Appl. No.: 313,170

[22] PCT Filed: Feb. 9, 1994

[86] PCT No.: PCT/EP94/00367

§ 371 Date: Dec. 2, 1994

§ 102(e) Date: Dec. 2, 1994

[87] PCT Pub. No.: WO94/18498

PCT Pub. Date: Aug. 18, 1994

[30] Foreign Application Priority Data

Feb. 9, 1993 [DE] Germany ..... 43 036 13.9

[51] Int. Cl.[6] ..... F22D 7/00

[52] U.S. Cl. ..... 122/406.1; 122/33; 122/406.4; 122/451 R

[58] Field of Search ..... 122/33, 34, 406.1, 122/406.4, 406.5, 451

[56] References Cited

U.S. PATENT DOCUMENTS 3,120,839 2/1964 Glahe .
3,464,393 9/1969 Chambert ..... 122/406.1
3,576,178 4/1971 Zmola ..... 122/406.1
4,072,182 2/1978 Cheng ..... 122/406.4
5,189,988 3/1993 Budin et al. ..... 122/6 A

FOREIGN PATENT DOCUMENTS 768201 2/1957 United Kingdom .

*Primary Examiner*—Henry A. Bennett
*Assistant Examiner*—Siddharth Ohri
*Attorney, Agent, or Firm*—Robert W. Becker & Associates

[57] ABSTRACT

A method and apparatus for generating steam in a forced-through-flow boiler. During operation, water is conveyed through a preheater, an evaporator and, if needed, a superheater. For such a boiler operated with waste heat, the evaporator is divided into at least two sections, a first one of which is supplied with water at the beginning of a start-up phase and is included in a water circulation, while a second one of the evaporator sections, starting from a dry state, is gradually supplied with water in a controlled manner until, in an operating state, water successively flows through both of the evaporator sections. During the start-up phase, and if desired in low load states, a water-steam mixture is conveyed to a separation tank, from which steam is withdrawn and separated feed water is supplied to the preheater.

5 Claims, 1 Drawing Sheet

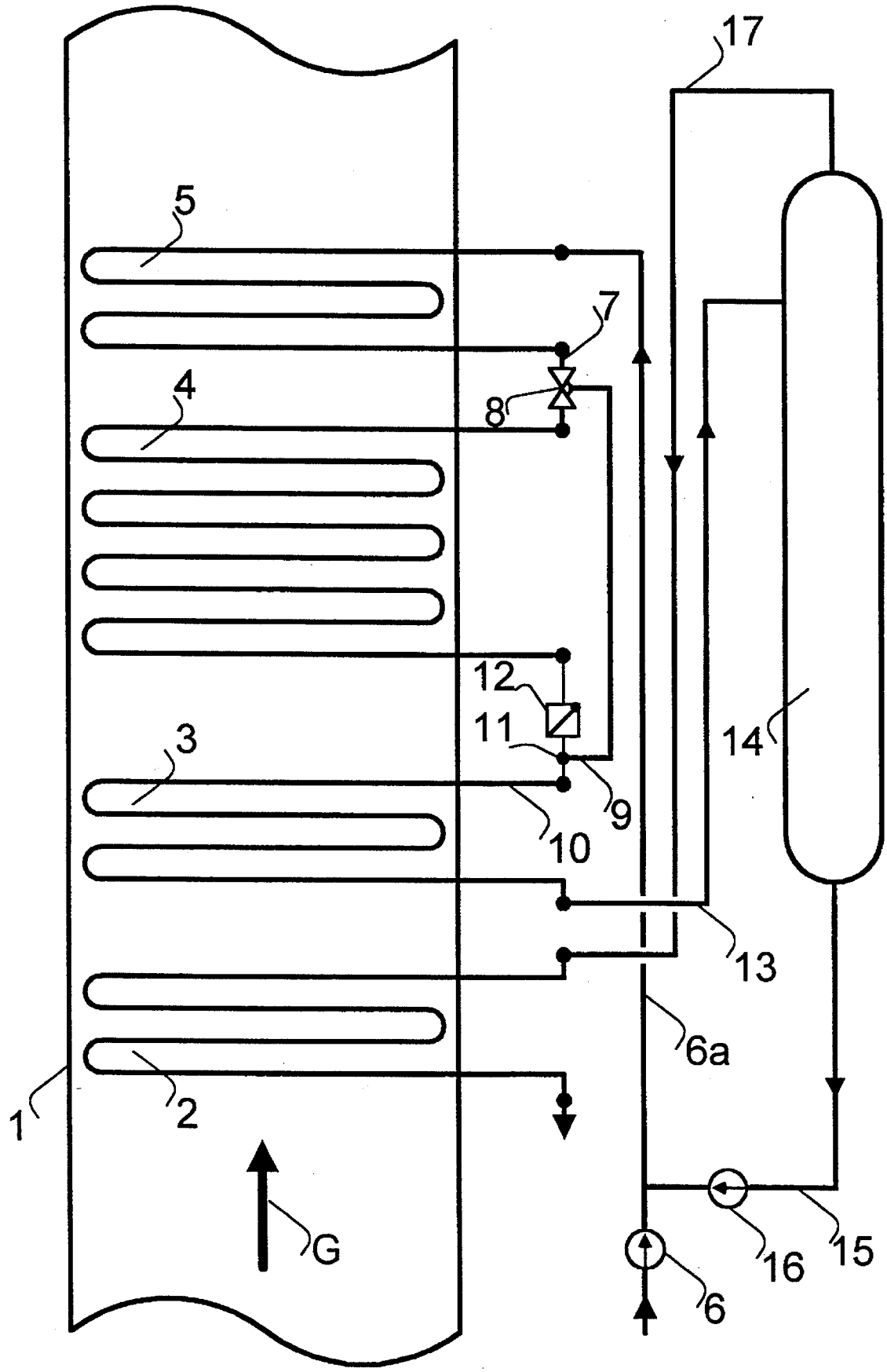
17
5
7
4
8
12
11
14
3
9
10
13
6a
1
2
G
16
15
6

METHOD OF GENERATING STEAM IN A FORCED-THROUGH-FLOW BOILER

BACKGROUND OF THE INVENTION

The invention relates to a method of generating steam in a forced-through-flow boiler or steam generator, in particular a BENSON boiler where during operation of the boiler, water is conveyed at least through a preheater, an evaporator and, if needed, a superheater, and during the start-up phase, and if desired in low load states, a water-steam mixture is conveyed to a separation tank, from which steam is withdrawn and separated feed water is supplied to the preheater.

With forced-through-flow boilers that are direct fired with fossil fuels, the evaporator, in which the water path is disposed downstream of the feed water preheater, contains a relatively small quantity of water which at the beginning of the formation of steam can be easily withdrawn via the separation tank.

Where waste heat steam generators, especially those disposed after gas turbines, are embodied as forced-through-flow boilers, care must be taken that due to the relatively great quantities of flue gas, evaporator heat transfer surfaces having a large water content are provided. Thus, during start-up of such steam generators, one must count on a large water discharge.

It is therefore an object of the present invention to provide a method of the aforementioned general type that is suitable in a straightforward manner to generate steam in a forced-through-flow steam generator that operates with waste heat.

SUMMARY OF INVENTION

This object is realized in that for a forced-through-flow boiler that operates with waste heat, the evaporator is divided into at least two sections, one of which being supplied with water at the beginning of the start-up phase and being included in a water circulation, while the other, starting from a dry state, is gradually supplied with water in a controlled manner until, in an operating state, water successively flows through both of the evaporator sections.

The evaporator section that at the beginning of the start-up phase is "dry" ensures that at the beginning of evaporation in the evaporator section to which water is supplied only that quantity of water is discharged that can be reliably handled by the separation tank.

In a preferred manner, that section of the evaporator that at the beginning of the start-up phase is kept in the water circulation is that section through which the gas from which the waste heat is to be extracted flows first.

It is furthermore expedient to dispose in the connecting line between the feed water flow-through means (e.g. the preheater) and the evaporator a three-way valve, the branch line of which, as a bypass line, leads to the evaporator section to which water is to be supplied.

It also appears to be expedient to associate with the outlet of the evaporator section to which water is not to be initially supplied a check valve in such a way that a back filling of the evaporator section via the bypass line is precluded.

BRIEF DESCRIPTION OF THE DRAWING

The present invention is also directed to an apparatus for carrying out the method.

The inventive method and the inventive apparatus will now be described in detail with the aid of the accompanying drawing which shows one exemplary embodiment of the inventive apparatus for carrying out the inventive method.

DESCRIPTION OF PREFERRED EMBODIMENTS

The drawing shows that a flue gas G, from which heat is to be withdrawn, flows through a waste heat tank or exchanger 1. The gas initially flows through a superheater 2, and then enters an evaporator section 3; thereafter, the gas flows through an evaporator section 4 and a feed water preheater 5 that is disposed downstream therefrom. The preheater 5 for feed water is supplied with feed water that is conveyed by a feed water pump 6 over a line **6*a*. Disposed in the connecting line 7 between the feed water preheater 5 and the evaporator section 4 is a three-way valve 8. The branch line 9 is connected with the connecting line 10 between the two evaporator sections 4 and 3. Disposed between the point of connection 11 and the evaporator section 4 in the line 10 is a check valve 12 that closes when flow approaches through the line 9 and opens when flow approaches from the evaporator section 4. The evaporator section 3 is furthermore connected via a line 13 to a separation tank 14 from which, during the starting phase, water can be conveyed via a line 15 and a circulation pump 16 and on the pressure side of the feed water pump 6 into the feed water line 6*a* that leads to the preheater 5. Steam can be withdrawn from the separation tank 14 via a line 17 and can be conveyed to the superheater 2** for superheating.

During start-up, the evaporator heat transfer surface 4 is first kept dry, with water being supplied only to the evaporator heat transfer surface 3. Thereafter, the three-way valve 8 is adjusted in a controlled manner, so that water is supplied to the evaporator section 4 in a prescribed manner. At the very latest upon attainment of full load, the bypass line 9 no longer receives flow.

It is to be understood that a water/steam mixture can also be supplied to the tank 14 not only during start-up, but if desired also at low loads via the line 13.

The inventive method of operation and the inventive configuration of the apparatus ensure that only that amount of water discharged occurs that can be accommodated by a standard size separation tank 14.

The present invention is, of course, in no way restricted to the specific disclosure of the specification and drawing, but also encompasses any modifications within the scope of the appended claims.

What is claimed is:

1. A method of generating steam in a forced-through-flow boiler, said method including the steps of:

during operation, conveying water through a preheater and an evaporator, whereby for a forced-through-flow boiler operated with a flow of gas from which waste heat is to be extracted, said evaporator is divided into at least two sections, wherein when viewed in a direction of flow of said gas from which waste heat is to be extracted, a first one of said evaporator sections is supplied with water at a beginning of a start-up phase and is included in a water circulation, while downstream from said first evaporator section when viewed in said direction of flow of said waste heat gas, a second one of said evaporator sections, starting from a dry state, is gradually supplied with water in a controlled manner until, in an operating state, water successively flows through both of said evaporator sections;

at least during said start-up phase, conveying a water-stream mixture from said first evaporator section to a separation tank, from which steam is withdrawn and separated feed water is supplied to said preheater, which is disposed downstream from said second evaporator section when viewed in said direction of flow of said waste heat gas; and disposing a three-way valve in a connecting line between said preheater and said evaporator, with said three-way valve having a branch line that acts as a bypass line and leads to said first one of said evaporator sections.

2. A method according to claim 1, wherein said second one of said evaporator sections that is initially not supplied with water is provided with an outlet with which is associated a check valve that prevents back filling of said second one of said evaporator sections from said bypass line.

3. A forced-through-flow steam generator comprising a preheater, an evaporator, a superheater and a separation tank, wherein said evaporator comprises two evaporator sections that are connectable in series to be part of a water circulation comprised of said preheater, said evaporator and said separation tank, and means for separating one of said evaporator sections from said water circulation.

4. A method according to claim 1, which includes the step of conveying steam from said separation tank through a superheater.

5. A method according to claim 1, which includes the step of also conveying a water-steam mixture from said first evaporator section to a separation tank in low load states.

* * * * *